US011328664B2

(12) United States Patent
Hong et al.

(10) Patent No.: US 11,328,664 B2
(45) Date of Patent: May 10, 2022

(54) PIXEL SENSING DEVICE AND ORGANIC LIGHT EMITTING DISPLAY DEVICE INCLUDING THE SAME

(71) Applicant: LG Display Co., Ltd., Seoul (KR)

(72) Inventors: Seokhyun Hong, Paju-si (KR); Changwoo Lee, Daegu (KR)

(73) Assignee: LG Display Co., Ltd., Seoul (KR)

( * ) Notice: Subject to any disclaimer, the term of this patent is extended or adjusted under 35 U.S.C. 154(b) by 67 days.

(21) Appl. No.: 16/693,153

(22) Filed: Nov. 22, 2019

(65) Prior Publication Data

US 2020/0175919 A1 Jun. 4, 2020

(30) Foreign Application Priority Data

Nov. 29, 2018 (KR) ..... 10-2018-0151001

(51) Int. Cl.
*G09G 3/3233* (2016.01)
*G09G 3/3241* (2016.01)
*G09G 3/325* (2016.01)

(52) U.S. Cl.
CPC ..... *G09G 3/3233* (2013.01); *G09G 3/3241* (2013.01); *G09G 3/325* (2013.01); *G09G 2310/08* (2013.01); *G09G 2320/029* (2013.01); *G09G 2320/0233* (2013.01)

(58) Field of Classification Search
CPC .... G09G 3/3233; G09G 3/3241; G09G 3/325; G09G 2310/08; G09G 2320/0233; G09G 2320/029
See application file for complete search history.

(56) References Cited

U.S. PATENT DOCUMENTS 9,305,494 B2 4/2016 Shim et al.
9,685,119 B2 6/2017 Kim et al.
10,720,100 B2 7/2020 Lee et al.
(Continued)

FOREIGN PATENT DOCUMENTS

CN 104751781 A 7/2015
CN 105321455 A 2/2016
(Continued)

OTHER PUBLICATIONS

English translation to KR 20170080775, Inventor Hong Seok Hyun, assignee LG display, publication date Jul. 11, 2017. (Year: 2017).*

*Primary Examiner* — William Boddie
*Assistant Examiner* — Saifeldin E Elnafia
(74) *Attorney, Agent, or Firm* — Seed IP Law Group LLP

(57) ABSTRACT

The present disclosure relates to a pixel sensing device and the organic light emitting display device including the same which reduce or minimize the influence of the panel noise and improve sensing accuracy and sensing reliability. The pixel sensing device includes a current integrator connected to a pixel through a sensing line of a display panel and integrating a pixel current flowing through the pixel to generate an integrator output voltage; a sample and hold unit sampling and holding the integrator output voltage; an analog to digital converter (ADC) converting the integrator output voltage output from the sample and hold unit into a digital signal; and a first capacitor serving to reduce or minimize a distortion degree of the integrator output voltage due to panel noise mixed to the pixel current.

20 Claims, 14 Drawing Sheets

(56) References Cited

U.S. PATENT DOCUMENTS

| | | | | |
|---|---|---|---|---|
| 2009/0096818 | A1* | 4/2009 | Nishimura | G09G 3/3291 345/690 |
| 2016/0240122 | A1* | 8/2016 | Yu | G09G 3/006 |
| 2017/0256199 | A1* | 9/2017 | Bi | G09G 3/20 |
| 2018/0082621 | A1* | 3/2018 | Lin | G09G 3/20 |

FOREIGN PATENT DOCUMENTS

| | | | |
|---|---|---|---|
| CN | 108109585 | A | 6/2018 |
| EP | 3 229 225 | A1 | 11/2017 |
| GB | 2564916 | A | 1/2019 |
| JP | S53-101967 | A | 9/1978 |
| JP | H01-212923 | A | 8/1989 |
| JP | 2000-332957 | A | 11/2000 |
| JP | 2016-009185 | A | 1/2016 |
| JP | 2017-107243 | A | 6/2017 |
| JP | 2018-084811 | A | 5/2018 |
| KR | 10-2015-0020816 | A | 2/2015 |
| KR | 10-2017-0080775 | A | 7/2017 |
| KR | 10-2018-0045937 | A | 5/2018 |

* cited by examiner

PIXEL SENSING DEVICE AND ORGANIC LIGHT EMITTING DISPLAY DEVICE INCLUDING THE SAME

CROSS-REFERENCE TO RELATED APPLICATION(S)

This application claims is based on and claims priority to Korea Patent Application No. 10-2018-0151001 filed on Nov. 29, 2018, which are incorporated herein by reference for all purposes as if fully set forth herein.

BACKGROUND

Technical Field

The present disclosure relates to a pixel sensing device and an organic light emitting display device including the same.

Description of the Related Art

An organic light emitting display device of an active matrix type arranges the pixels each including an organic light emitting diode OLED a driving Thin Film Transistor TFT in a matrix form and controls the luminance of the image represented in the pixels according to the grayscale of image data. The driving TFT controls the pixel current flowing through the OLED according to the voltage applied between a gate electrode and a source electrode of the driving TFT (hereinafter, referred to as "gate-source voltage"). The amount of light emitted by the OLED and the luminance of a screen are determined according to the pixel current.

Since the threshold voltage and electron mobility of the driving TFT, the operating point voltage of the OLED and the like determine the driving characteristics of a pixel, the characteristics of all pixels must be substantially the same. However, due to various causes such as process properties, time varying properties and the like, the driving characteristics become different among the pixels. Such a difference in driving characteristic causes a luminance deviation, which is a limitation in displaying image as desired quality. As a method of compensating for the luminance deviation between pixels, the external compensating scheme is known which senses the driving characteristics of pixels and adjusts input image data based on the sensing results.

BRIEF SUMMARY

Among the external compensating scheme, there is a method of sensing the pixel current flowing through the driving TFT using a current integrator in order to sense the driving characteristics of pixels. This method determines the change in the pixel current through the voltage difference between the reference voltage and the output voltage of the current integrator.

The current integrator is connected to respective pixels through sensing lines in a display panel. So, panel noise may be reflected on the pixel current sensed by the current integrator. The panel noise may be caused by various causes such as process properties, driving environment, etc., and may affect sensing channels in different sizes. Since the panel noise is amplified by an amplifier of the current integrator and distorts the output voltage of the integrator, the sensing results for a same pixel current may be different between current integrators.

Accordingly, in some embodiments, the present disclosure provides a pixel sensing device and the organic light emitting display device including the same which reduce or minimize the influence of the panel noise and improve sensing accuracy and sensing reliability.

According to one aspect of the present disclosure, a pixel sensing device includes: a current integrator connected to a pixel through a sensing line of a display panel and integrating a pixel current flowing through the pixel to generate an integrator output voltage; a sample and hold unit sampling and holding the integrator output voltage; an analog to digital converter (ADC) converting the integrator output voltage output from the sample and hold unit into a digital signal; and a first capacitor serving to reduce or minimize a distortion degree of the integrator output voltage due to panel noise mixed to the pixel current.

According to another aspect of the present disclosure, an organic light emitting display device includes: a display panel including a plurality of pixels; and a sensing unit for sensing driving characteristics of the pixel. The sensing unit may include a current integrator connected to the pixel through a sensing line of the display panel and integrating a pixel current flowing through the pixel to generate an integrator output voltage, a sample and hold unit sampling and holding the integrator output voltage, an analog to digital converter (ADC) converting the integrator output voltage output from the sample and hold unit into a digital signal, and a first capacitor serving to reduce or minimize a distortion degree of the integrator output voltage due to panel noise mixed to the pixel current.

BRIEF DESCRIPTION OF THE SEVERAL VIEWS OF THE DRAWINGS

The accompanying drawings, which are included to provide a further understanding of the present disclosure and are incorporated in and constitute a part of this specification, illustrate embodiments of the present disclosure and together with the description serve to explain the principles of the present disclosure. In the drawings.

DETAILED DESCRIPTION

Figure 1:
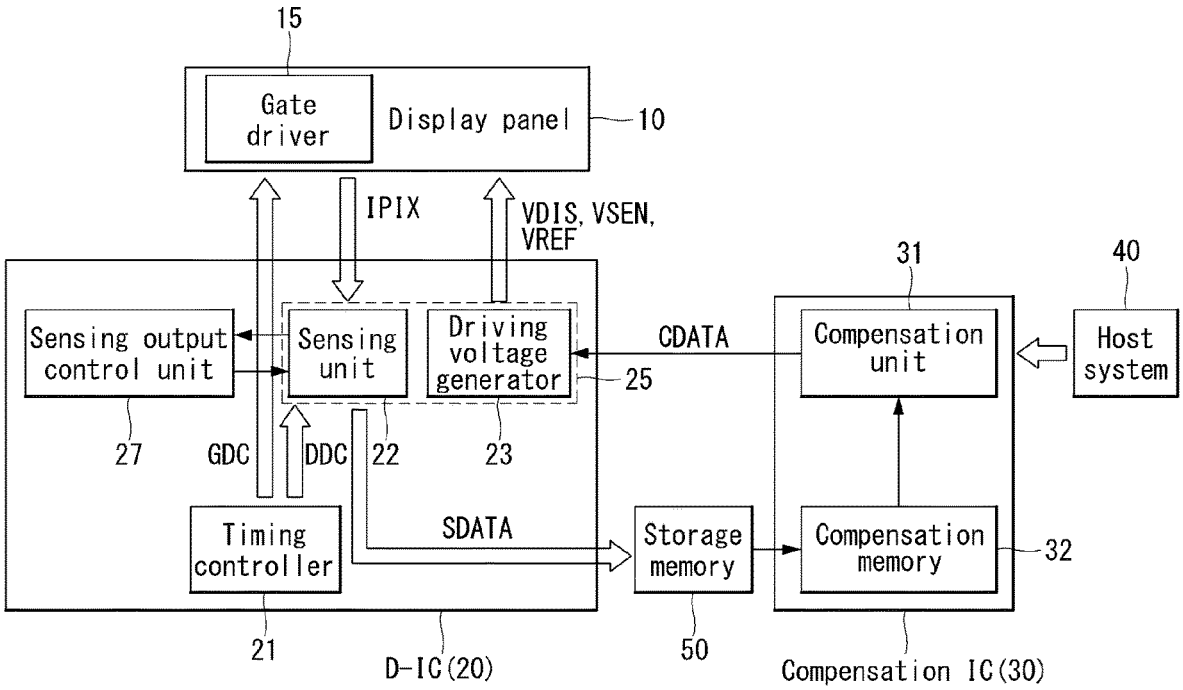
FIG. 1 shows a block diagram illustrating an organic light emitting display device according to an embodiment of the present disclosure.

The advantages and features of the present disclosure and methods of accomplishing the same may be understood more readily by reference to the following detailed descriptions of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the present disclosure to those skilled in the art, and the present disclosure is defined by the appended claims.

The shapes, sizes, percentages, angles, numbers, etc., shown in the figures to describe the exemplary embodiments of the present disclosure are merely examples and not limited to those shown in the figures. Like reference numerals denote like elements throughout the specification. When the terms 'comprise', 'have', 'include' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on', 'over', 'connect', 'coupled', 'under', 'next to' and the like, one or more parts may be positioned between the two parts as long as the term 'immediately' or 'directly' is not used.

It will be understood that, although the terms first, second, etc., may be used to describe various elements, these elements should not be limited by these terms. These terms are only used to distinguish one element from another element. Thus, a first element referred to below may be a second element within the scope of the present disclosure.

In this specification, the pixel circuit and the gate driver formed on the substrate of a display panel may be implemented by a TFT of an n-type MOSFET structure, but the present disclosure is not limited thereto so the pixel circuit and the gate driver may be implemented by a TFT of a p-type MOSFET structure. The TFT or the transistor is the element of 3 electrodes including a gate, a source and a drain. The source is an electrode for supplying a carrier to the transistor. Within the TFT the carrier begins to flow from the source. The drain is an electrode from which the carrier exits the TFT. That is, the carriers in the MOSFET flow from the source to the drain. In the case of the n-type MOSFET NMOS, since the carrier is an electron, the source voltage has a voltage lower than the drain voltage so that electrons can flow from the source to the drain. In the n-type MOSFET, a current direction is from the drain to the source because electrons flow from the source to the drain. On the other hand, in the case of the p-type MOSFET PMOS, since the carrier is a hole, the source voltage has a voltage higher than the drain voltage so that holes can flow from the source to the drain. In the p-type MOSFET, a current direction is from the source to the drain because holes flow from the source to the drain. It should be noted that the source and drain of the MOSFET are not fixed. For example, the source and drain of the MOSFET may vary depending on the applied voltage. Therefore, in the description of the present disclosure, one of the source and the drain is referred to as a first electrode, and the other one of the source and the drain is referred to as a second electrode.

In this specification, the semiconductor layer of the TFT may be implemented by at least one of an oxide element, an amorphous silicon element, and a polysilicon element.

Hereinafter, various embodiments of the present disclosure will be described in detail with reference to the accompanying drawings. In describing the present disclosure, detailed descriptions of well-known functions or configurations related to the present disclosure will be omitted to avoid unnecessary obscuring the present disclosure.

Figure 2:
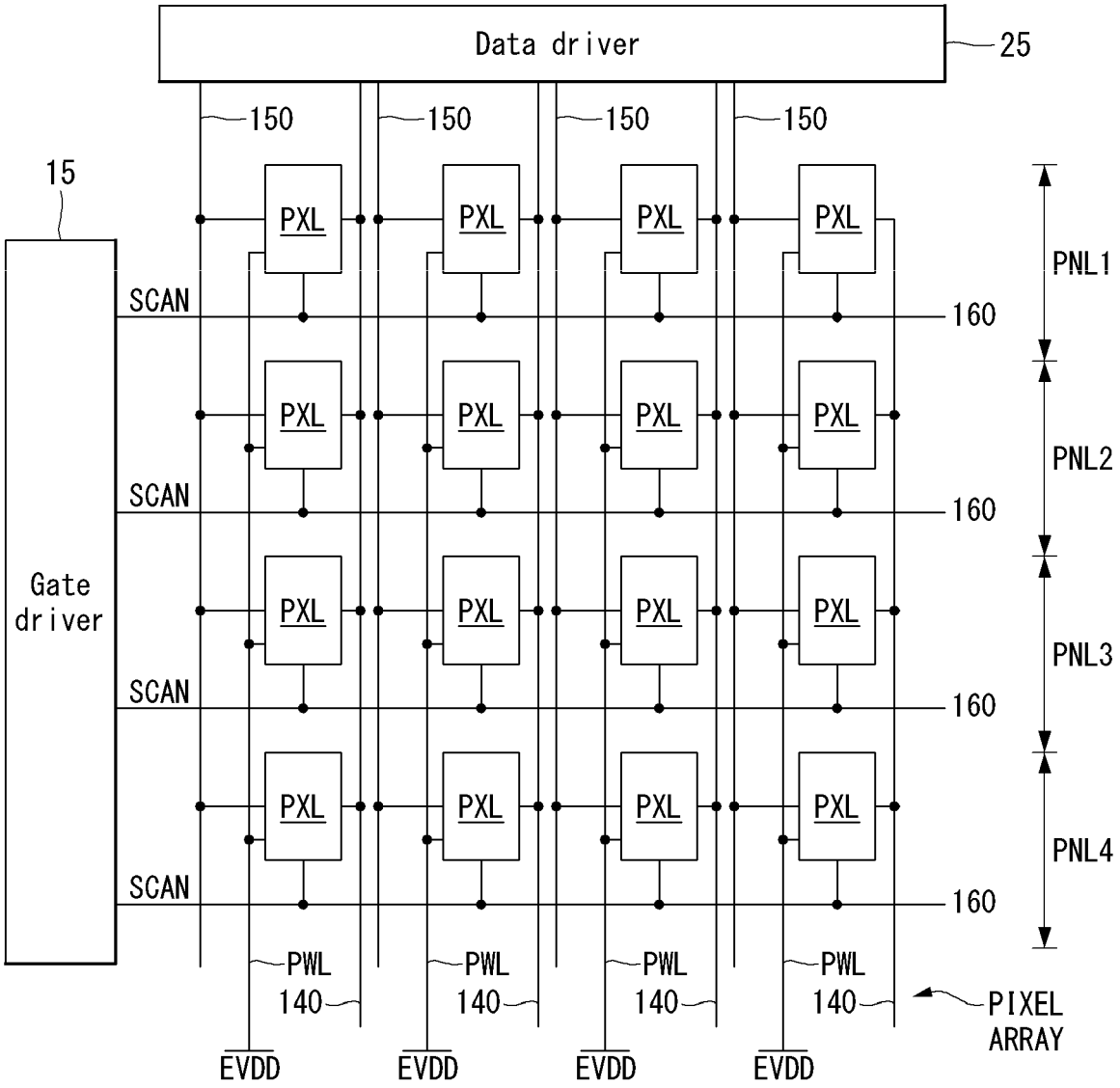
FIG. 2 shows a pixel array equipped in the display panel of FIG. 1.

FIG. 1 shows a block diagram illustrating an organic light emitting display device according to an embodiment of the present disclosure, and FIG. 2 shows a pixel array equipped in the display panel of FIG. 1.

Referring to FIGS. 1 and 2, the organic light emitting display device may comprise a display panel 10, a driver IC D-IC 20, a compensating IC 30, a host system 40 and a storage memory 50. The panel driving unit of the present disclosure may include a gate driving unit 15 equipped in the display panel 10 and a data driving unit 25 imbedded in the driver IC D-IC 20. The term "unit" used herein is used broadly to indicate electronic circuits, modules of an electronic system implemented with circuitry, or the like.

The display panel 10 is equipped with a plurality of pixel lines PNL1~PNL4, and each pixel line is equipped with a plurality of pixels PXL and a plurality of signal lines. The pixel line in the present disclosure does not mean a physical signal line, but means a collection of the pixels PXL adjacent to each other along the direction in which a gate line extends and the signal lines. The signal lines may include the data lines 140 for supplying to the pixels PXL the data voltage for displaying VDIS and the data voltage for sensing VSEN, the reference voltage lines 150 for supplying a reference voltage VREF to the pixels PXL, the gate lines 160 for supplying gate signals to the pixels PXL and the high potential power lines PWL for supplying a high potential pixel voltage to the pixels PXL.

The pixels PXL in the display panel 10 are arranged in a matrix form to constituting a pixel array. Each pixel PXL included in the pixel array in FIG. 2 may be connected to one of the data lines 140, one of the reference voltage lines 150, one of the high potential power lines PWL and one of the gate lines 160. Each pixel PXL included in the pixel array in FIG. 2 may be connected to a plurality of the gate lines 160. And, a low potential pixel voltage may be supplied to each pixel PXL included in the pixel array in FIG. 2 from a power generating unit. The power generating unit may supply the low potential pixel voltage to the pixels PXL through a low potential power line or a padding unit.

The gate driving unit 15 may be embedded in the display panel 10.

The gate driving unit 15 may include a plurality of stages connected to the gate lines 160 of the pixel array in FIG. 2. The stages may generate the gate signals for controlling the switch elements included in the pixels PXL and supply them to the gate lines 160.

The driver IC D-IC 20 may include a timing controller 21 and a data driving unit 25. The data driving unit 25 may include a sensing unit 22 and a driving voltage generator 23, but is not limited thereto.

The timing controller 21 may generate the gate timing control signals GDC for controlling the operating timings of the gate driving unit 15 and the data timing control signals DDC for controlling the operating timings of the data driving unit 25, based on the timing signals input from the host system 40, for example a vertical synchronization signal Vsync, a horizontal synchronization signal Hsync, a dot clock signal DCLK, a data enable signal DE, and so on.

The data timing control signals DDC may include a source start pulse, a source sampling clock, a source output enable signal, and so on, but are not limited thereto. The source start pulse controls a data sampling start timing of the driving voltage generator 23. The source sampling clock is a clock signal for controlling a data sampling timing based on a rising or falling edge. The source output enable signal controls an output timing of the driving voltage generator 23.

The gate timing control signals GDC may include a gate start pulse, a gate shift clock, and so on, but are not limited thereto. The gate start pulse is applied to the stage of generating a first scan signal to activate the stage. The gate shift clock is commonly supplied to the stages to shift the gate start pulse.

The timing controller 21 may sense the driving characteristics of the pixels PXL during at least one of a power on section, vertical active intervals in each frame, a vertical blank interval in each frame and a power off section by controlling the operating timing of the panel driving unit. Here, the power on section means the period until image is displayed immediately after system power is applied, and the power off section means the period until the system power is turned off immediately after the image display is terminated. The vertical active interval is the period during which image data is written to the display panel 10 for representing screen, and the vertical blank interval is located between adjacent vertical active intervals and means the period during which the writing of the image data is suspended. The driving characteristics include the threshold voltage and electron mobility of the driving elements included in the pixels PXL.

The timing controller 21 may implement display driving and sense driving by controlling sense driving timing and display driving timing for pixel lines PNL1~PNL4 in the display panel 10 according to a predetermined sequence.

The timing controller 21 may generate the timing control signals GDC and DDC for the display driving and the timing control signals GDC and DDC for the sense driving differently from each other. The sense driving means the operations which write the data voltage for sensing VSEN to the pixels PXL included in the pixel line to sense the driving characteristics of the corresponding pixels PXL, and update the compensating values for compensating for the change of the driving characteristics of the corresponding pixels PXL based on the data of the sensing results SDATA. The display driving means the operations which correct the digital image data to be input to the corresponding pixels PXL based on the updated compensating values, and apply to the corresponding pixels PXL the data voltage for displaying VDIS which corresponds to the corrected image data CDATA to display input image.

The driving voltage generator 23 is implemented by the digital to analog converter DAC for converting a digital signal into an analog signal. The driving voltage generator 23 generates the data voltage for sensing VSEN for the sense driving and the data voltage for displaying VDIS for the display driving and supplies them to the data lines 140. Also, the driving voltage generator 23 generates the reference voltage VREF for the sense driving and the display driving and supplies it to the reference voltage lines 150.

The data voltage for displaying VDIS may be a result of digital-to-analog conversion for the digital image data CDATA corrected in the compensating IC 30, and the magnitude of the data voltage for displaying VDIS may vary in pixel units according to a grayscale value and a compensating value. The data voltage for sensing VSEN may be set different in units of R (red), G (Green), B (blue) and W (white) pixels in considering that the driving characteristics of the driving elements are different for respective colors.

The sensing unit 22 may sense the driving characteristics of the pixels PXL, for example the threshold voltage and electron mobility of a driving element, the operating point voltage of a light emitting element, and the like, to the sensing lines. The sensing lines may be implemented by using the data lines 140 or the reference voltage lines 150. If the data lines 140 are utilized as the sensing lines, it is possible to unify a data output channel and a sensing channel, which is advantageous in reducing the number of pads of the driver IC D-IC 20. The sensing unit 22 may be implemented as a current sensing type of directly sensing the pixel current flowing through each pixel PXL. To this end, the sensing unit 22 may include a current integrator and a capacitor for suppressing panel noise, and this will be described in detail with reference to FIG. 7. And, the sensing unit 22 may include the current integrator, the capacitor for suppressing the panel noise and an offset removing circuit, and this will be described in detail with reference to FIG. 11.

The sensing unit 22 may simultaneously or concurrently process a plurality of analog sensing values in parallel by using a plurality of ADCs, or may process the plurality of analog sensing values in a sequential manner using one ADC. The sampling rate and accuracy of the ADC are trade-offed to each other. The ADC of a parallel processing method have the advantage of increasing sensing accuracy because it can slow down a sampling rate compared to the ADC of a serial processing manner. The ADC may be implemented as the ADC of a flash type, the ADC using a tracking scheme, the ADC of a successive approximation register type, and so on. The ADC converts analog sensing values into digital sensing result data SDATA within a predetermined sensing range, and supplies the digital sensing result data SDATA to the storage memory 50 and the sensing output control unit 27.

The storage memory 50 stores the digital sensing result data SDATA input from the sensing unit 22 in sense driving. The storage memory 50 may be implemented as a flash memory, but not limited thereto.

The compensating IC 30 may include a compensating unit 31 and a compensating memory 32. The compensating memory 32 transmits the digital sensing result data SDATA read from the storage memory 50 to the compensating unit 31. The compensating memory 32 may be a random access memory RAM, for instance a double data rate synchronous dynamic RAM, but not limited thereto. The compensating unit 31 calculates a compensating offset and a compensating gain for each pixel based on the digital sensing result data SDATA read from the storage memory 50, corrects the image data input from the host system 40 according to the compensating offset and gain, and supplies the corrected image data CDATA to the driver IC D-IC 20.

Figure 3:
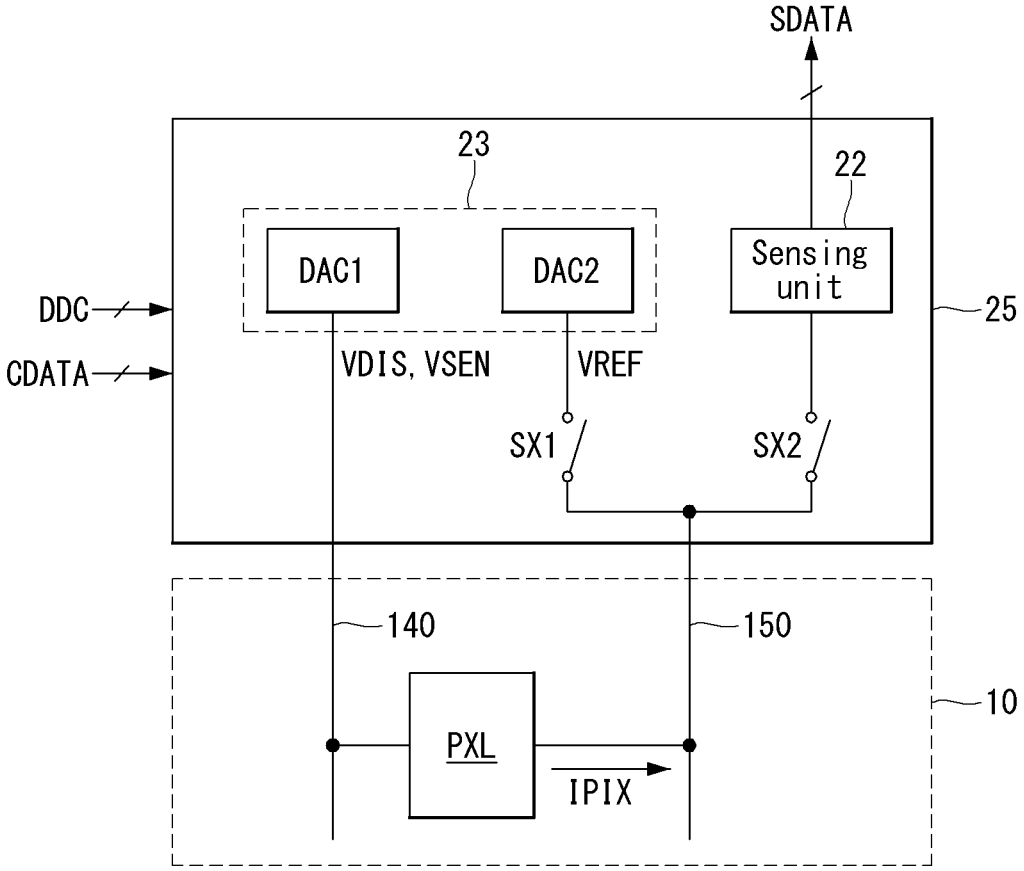
FIG. 3 shows the configuration of the data driving unit connected to the pixel array of FIG. 2.

FIG. 3 shows the configuration of the data driving unit connected to the pixel array of FIG. 2. The data driving unit 25 in FIG. 3 senses the driving characteristics of the pixels PXL through the reference voltage line 150.

Referring to FIG. 3, the data driving unit 25 may be connected to the first node of the pixel PXL (e.g., the gate electrode of a driving element) through the data line 140, and connected to the second node of the pixel PXL (e.g., the source electrode of the driving element) through the reference voltage line 150. Since a pixel current IPIX flows through the second node of the pixel PXL, the reference voltage line 150 connected to the second node via a second switching element may be used as a sensing line.

The reference voltage line 150 is selectively connected to the driving voltage generator 23 and the sensing unit 22 through connecting switches SX1 and SX2. The driving voltage generator 23 may comprise a first driving voltage generator DAC1 for generating the data voltage for sensing VSEN and the data voltage for displaying VDIS, and a second driving voltage generator DAC2 for generating the reference voltage VREF. The first connecting switch SX1 is connected between the reference voltage line 150 and the second driving voltage generator DAC2, and the second connecting switch SX2 is connected between the reference voltage line 150 and the sensing unit 22. The first and second connecting switches SX1 and SX2 are selectively turned on. Only the first connecting switch SX1 is turned on in synchronization with the timing at which the reference voltage VREF is applied to the pixel PXL, and only the second connecting switch SX2 is turned on in synchronization with the timing at which the pixel current flowing through the pixel PXL is sensed. So, the reference voltage line 150 is selectively connected to the second driving voltage generator DAC2 and the sensing unit 22 via the first and second connecting switches SX1 and SX2.

Figure 4:
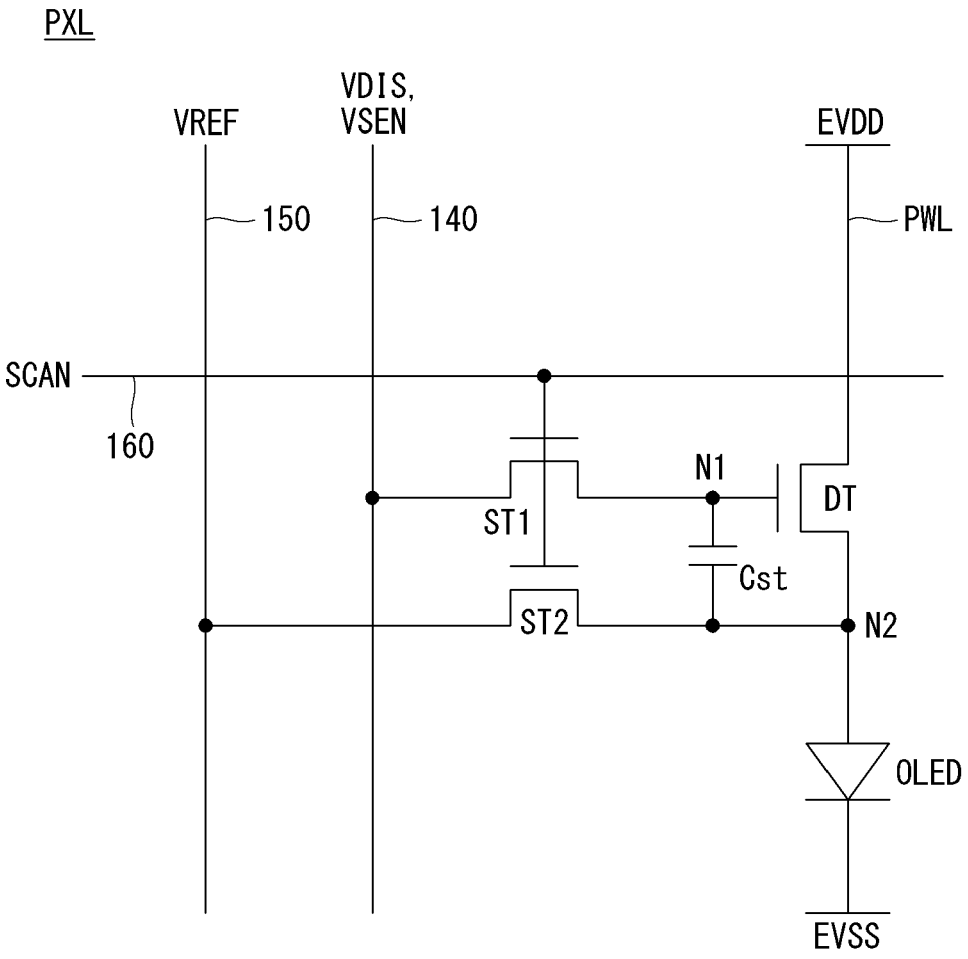
FIG. 4 shows an equivalent circuit of the pixel shown in FIG. 3.

FIG. 4 shows an equivalent circuit of the pixel shown in FIG. 3.

Referring to the FIG. 4, the pixel PXL utilizing the reference voltage line 150 as the sensing line comprises an OLED, a driving TFT DT, switching TFTs ST1 and ST2, and a storage capacitor Cst. The driving TFT DT and the switching TFTs ST1 and ST2 are implemented as NMOS, but not limited thereto.

The OLED is an element of emitting light with the intensity corresponding to the pixel current drawn from the driving TFT DT. An anode electrode of the OLED is connected to a second node N2 and a cathode electrode of the OLED is connected to an input terminal of a low potential voltage EVSS.

The driving TFT DT is a driving element for generating the pixel current according to the voltage difference between a gate electrode and a source electrode. The driving TFT DT comprises the gate electrode connected to a first node N1, the first electrode connected to an input terminal of a high potential voltage EVDD through the high potential power line PWL, and a second electrode connected to a second node N2.

The switching TFTs ST1 and ST2 are the switching elements that establish the voltage between the gate and source electrodes of the driving TFT DT and connect the second electrode of the driving TFT DT and the reference voltage line 150.

The first switching TFT ST1 is connected between the data line 140 and the first node N1 and turned on according to a gate signal SCAN from the gate line 160. The first switching TFT ST1 is turned on in the program for the display driving or the sense driving. When the first switching TFT ST1 is turned on, the data voltage for sensing VSEN or the data voltage for displaying VDIS is applied to the first node N1. In the first switching TFT ST1, a gate electrode is connected to the gate line 160, a first electrode is connected to the data line 140 and a second electrode is connected to the first node N1.

The second switching TFT ST2 is connected between the reference voltage line 150 and the second node N2 and turned on according to the gate signal SCAN from the gate line 160. The second switching TFT ST2 is turned on in the program for the display driving or the sense driving to apply the reference voltage VREF to the second node N2. The second switching TFT ST2 is also turned on in a sensing period during the sense driving, and applies the pixel current generated from the driving TFT DT to the reference voltage line 150. In the second switching TFT ST2, a gate electrode is connected to the gate line 160, a first electrode is connected to the reference voltage line 150 and a second electrode is connected to the second node N2.

The storage capacitor Cst is connected between the first node N1 and the second node N2 to hold the voltage between the gate and source electrodes of the driving TFT DT for a period of time.

Figure 5:
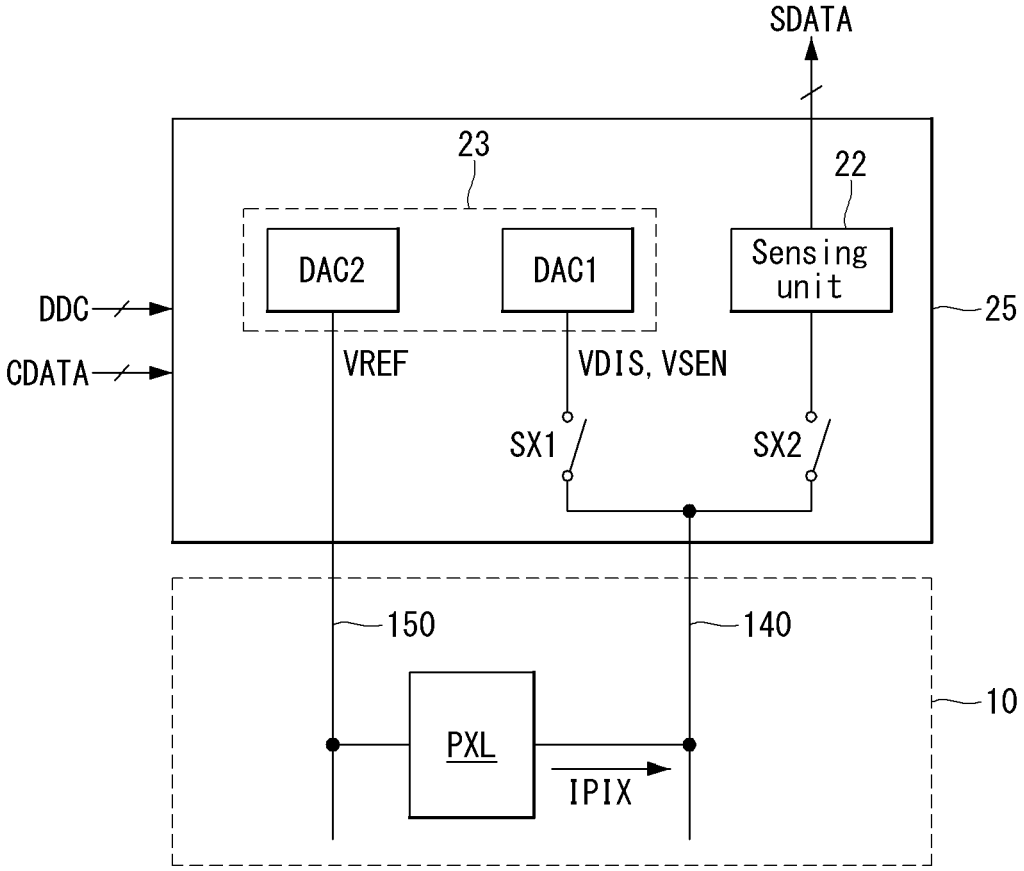
FIG. 5 shows another configuration of the data driving unit connected to the pixel array of FIG. 2.

FIG. 5 shows another configuration of the data driving unit connected to the pixel array of FIG. 2. The data driving unit 25 in FIG. 5 senses the driving characteristics of the pixels PXL through the data line 140.

Referring to FIG. 5, the data driving unit 25 may be connected to the first node of the pixel PXL (e.g., the gate electrode of a driving element) through the reference voltage line 150, and connected to the second node of the pixel PXL (e.g., the source electrode of the driving element) through the data line 140. Since a pixel current IPIX flows through the second node of the pixel PXL, the data line 140 connected to the second node via a second switching element may be used as a sensing line.

The data line 140 is selectively connected to the driving voltage generator 23 and the sensing unit 22 through connecting switches SX1 and SX2. The driving voltage generator 23 may comprise a first driving voltage generator DAC1 for generating the data voltage for sensing VSEN and the data voltage for displaying VDIS, and a second driving voltage generator DAC2 for generating the reference voltage VREF. The first connecting switch SX1 is connected between the data line 140 and the first driving voltage generator DAC1, and the second connecting switch SX2 is connected between the data line 140 and the sensing unit. The first and second connecting switches SX1 and SX2 are selectively turned on. Only the first connecting switch SX1 is turned on in synchronization with the timing at which the data voltage for sensing VSEN and the data voltage for displaying VDIS are applied to the pixel PXL, and only the second connecting switch SX2 is turned on in synchronization with the timing at which the pixel current flowing through the pixel PXL is sensed. So, the data line 140 is selectively connected to the first driving voltage generator DAC1 and the sensing unit 22 via the first and second connecting switches SX1 and SX2.

Figure 6:
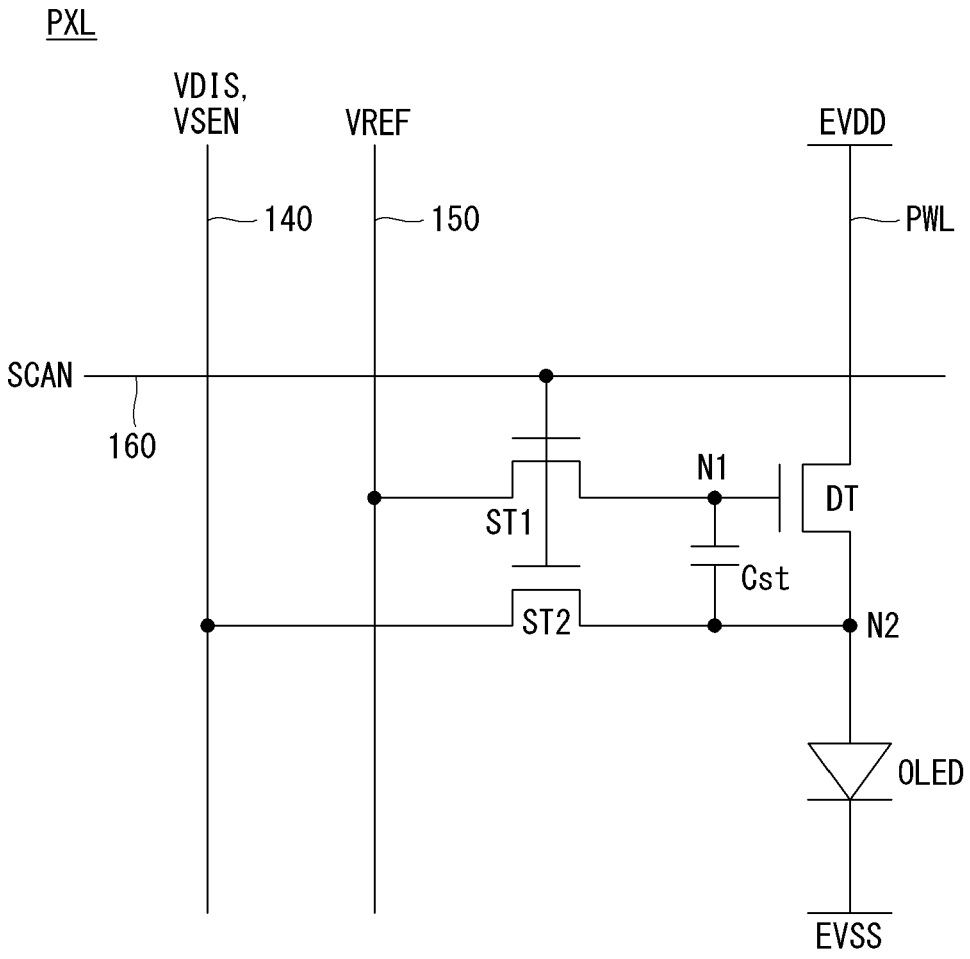
FIG. 6 shows an equivalent circuit of the pixel shown in FIG. 5.

FIG. 6 shows an equivalent circuit of the pixel shown in FIG. 5.

Referring to the FIG. 6, the pixel PXL utilizing the data line 140 as the sensing line comprises an OLED, a driving TFT DT, switching TFTs ST1 and ST2, and a storage capacitor Cst. The driving TFT DT and the switching TFTs ST1 and ST2 are implemented as NMOS, but not limited thereto.

The OLED is an element of emitting light with the intensity corresponding to the pixel current drawn from the driving TFT DT. An anode electrode of the OLED is connected to a second node N2 and a cathode electrode of the OLED is connected to an input terminal of the low potential voltage EVSS.

The driving TFT DT is a driving element for generating the pixel current according to the voltage difference between a gate electrode and a source electrode. The driving TFT DT comprises the gate electrode connected to a first node N1, a first electrode connected to an input terminal of the high potential voltage EVDD through the high potential power line PWL, and a second electrode connected to a second node N2.

The switching TFTs ST1 and ST2 are the switching elements that establish the voltage between the gate and source electrodes of the driving TFT DT and connect the second electrode of the driving TFT DT and the data line 140.

The first switching TFT ST1 is connected between the reference voltage line 150 and the first node N1 and turned on according to the gate signal SCAN from the gate line 160. The first switching TFT ST1 is turned on in the program for the display driving or the sense driving. When the first switching TFT ST1 is turned on, the reference voltage VREF is applied to the first node N1. In the first switching TFT ST1, a gate electrode is connected to the gate line 160, a first electrode is connected to the reference voltage line 150 and a second electrode is connected to the first node N1.

The second switching TFT ST2 is connected between the data line 140 and the second node N2 and turned on according to the gate signal SCAN from the gate line 160. The second switching TFT ST2 is turned on in the program for the display driving or the sense driving to apply the data voltage for sensing VSEN or the data voltage for displaying VDIS to the second node N2. The second switching TFT ST2 is also turned on in a sensing period during the sense driving, and applies the pixel current generated from the driving TFT DT to the data line 140. In the second switching TFT ST2, a gate electrode is connected to the gate line 160, a first electrode is connected to the data line 140 and a second electrode is connected to the second node N2.

The storage capacitor Cst is connected between the first node N1 and the second node N2 to hold the voltage between the gate and source electrodes of the driving TFT DT for a period of time.

Figure 7:
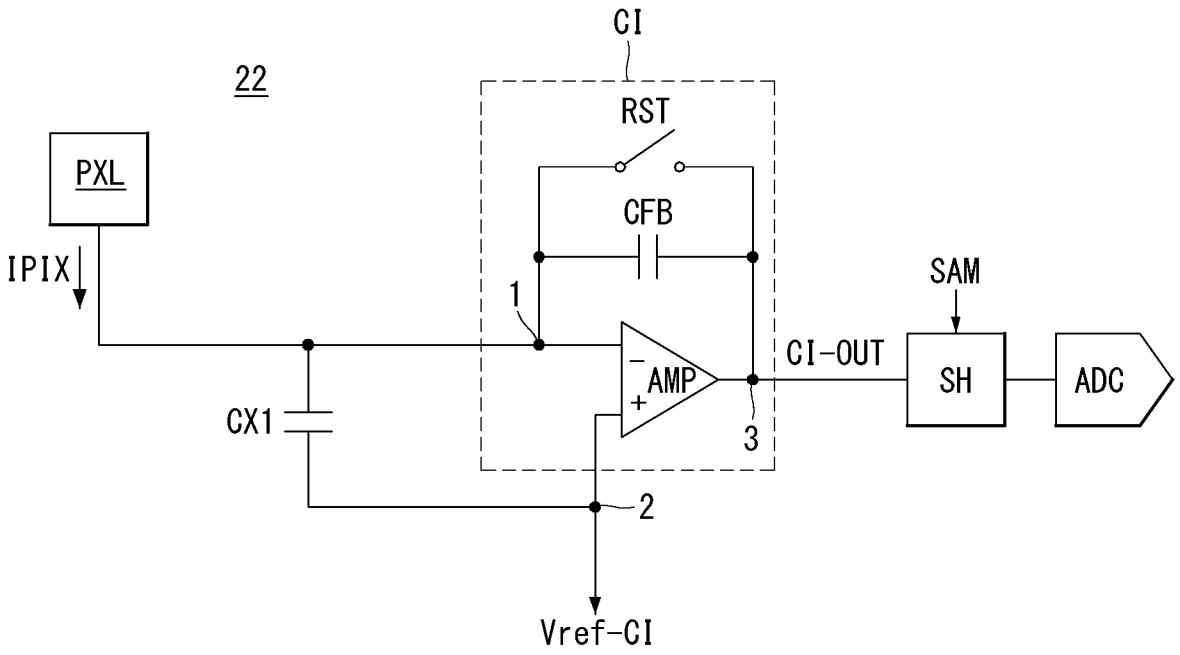
FIG. 7 shows the pixel sensing device according to an embodiment of the present disclosure.

FIG. 7 shows the pixel sensing device according to an embodiment of the present disclosure. The pixel sensing device in FIG. 7 includes the sensing unit 22 in FIG. 1.

Referring to FIG. 7, the sensing unit 22 may include a current integrator CI, a sample and hold unit SH, an ADC and a first capacitor CX1.

The current integrator CI is connected to a pixel PXL through a sensing line of the display panel 10. The current integrator CI integrates the pixel current IPIX flowing through the pixel PXL to generate an integrator output voltage CI-OUT that varies from an integrator reference voltage Vref-CI.

The current integrator CI comprises an amplifier AMP, an integrating capacitor CFB and a reset switch RST. The amplifier AMP is equipped with a first input terminal to receive the pixel current IPIX through a first node (1) connected to the sensing line, a second input terminal to receive the integrator reference voltage Vref-CI through a second node (2) and an output terminal to output the integrator output voltage CI-OUT corresponding to a result of integrating the pixel current IPIX to a third node (3). The integrating capacitor CFB is connected between the first node (1) and the third node (3), that is, the integrating capacitor CFB is connected between the first input terminal and the output terminal of the amplifier AMP. The reset switch RST is further connected between the first input terminal and the output terminal of the amplifier AMP in parallel with the integrating capacitor CFB.

The amplifier AMP may be implemented as a negative type or positive type. In the amplifier AMP of the negative type as shown in FIG. 7, the first input terminal is an inverting input terminal (−) of the amplifier AMP and the second input terminal is an non-inverting input terminal (+) of the amplifier AMP. In this negative-typed amplifier AMP, the integrator output voltage CI-OUT gradually decreases from the integrator reference voltage Vref-CI as the pixel current IPIX is accumulated in the integrating capacitor CFB. The falling slope of the integrator output voltage CI-OUT is proportional to the magnitude of the pixel current IPIX.

On the other hand, in amplifier AMP of the positive type, the first input terminal is an non-inverting input terminal (+) of the amplifier AMP and the second input terminal is an inverting input terminal (−) of the amplifier AMP. In this positive-typed amplifier AMP, the integrator output voltage CI-OUT gradually increases from the integrator reference voltage Vref-CI as the pixel current IPIX is accumulated in the integrating capacitor CFB. The rising slope of the integrator output voltage CI-OUT is proportional to the magnitude of the pixel current IPIX.

The idea of the present disclosure may be applied to the negative-typed amplifier and also applied to the positive-typed amplifier. In the embodiment of the present disclosure, the negative-typed amplifier will be mainly described for the sake of convenience.

The sample and hold unit SH samples and holds the integrator output voltage CI-OUT and then outputs it to the ADC. The sample and hold unit SH may comprise a sampling capacitor, a sampling switch and a holding switch operating according to a sampling signal SAM, but is not limited thereto.

The ADC converts an analog signal (that is the integrator output voltage) into a digital signal (that is digital sensing result data) within a predetermined sensing range.

The first capacitor CX1 serves to reduce or minimize the distortion degree of the integrator output voltage CI-OUT due to panel noise. The first capacitor CX1 is connected between the first node (1) and the second node (2) to couple the first input terminal (−) and the second input terminal (+) of the amplifier AMP. The first capacitor CX1 allows the panel noise which is mixed to the pixel current IPIX to be commonly applied to both the input terminals (+) and (−) of the amplifier AMP. The panel noise mixed to the pixel current IPIX is applied to the first input terminal (−) of the amplifier AMP and also applied to the second input terminal (+) of the amplifier AMP through the first capacitor CX1. So, the panel noise applied to both the input terminals (+) and (−) of the amplifier AMP may be canceled inside the amplifier AMP to be reduced or minimized.

The larger the capacitance of the first capacitor CX1, the smaller the amount of the panel noise that is mixed into the integrator output voltage CI-OUT. This is because the magnitude of the panel noise applied to the first input terminal (−) of the amplifier AMP becomes similar to that of the panel noise applied to the second input terminal (+) of the amplifier AMP as the capacitance of the first capacitor CX1 becomes larger. Ideally, when the magnitudes of the panel noise applied to both the input terminals (+) and (−) of the amplifier AMP are same, the panel noise to be mixed into the integrator output voltage CI-OUT may be completely canceled.

Figure 8:
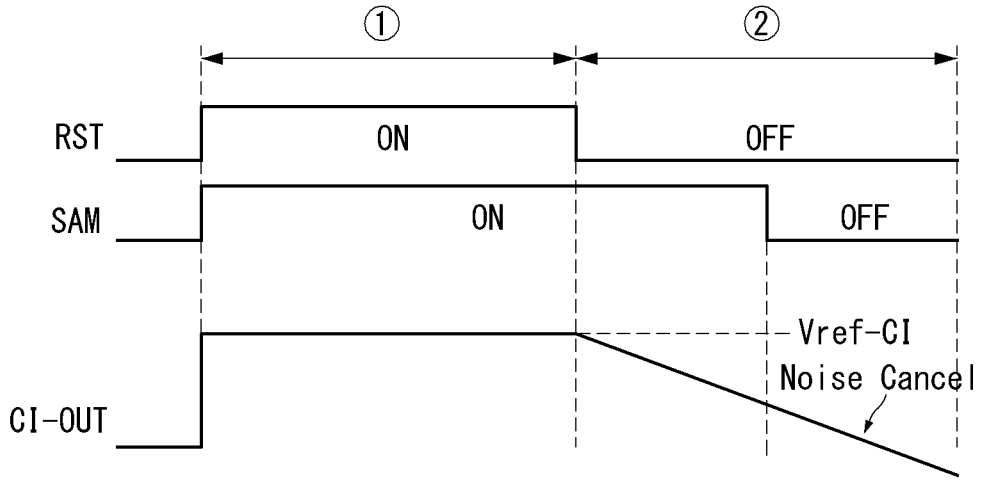
FIG. 8 shows the waveforms of the signals applied to the pixel sensing device in FIG. 7.
Figure 9:
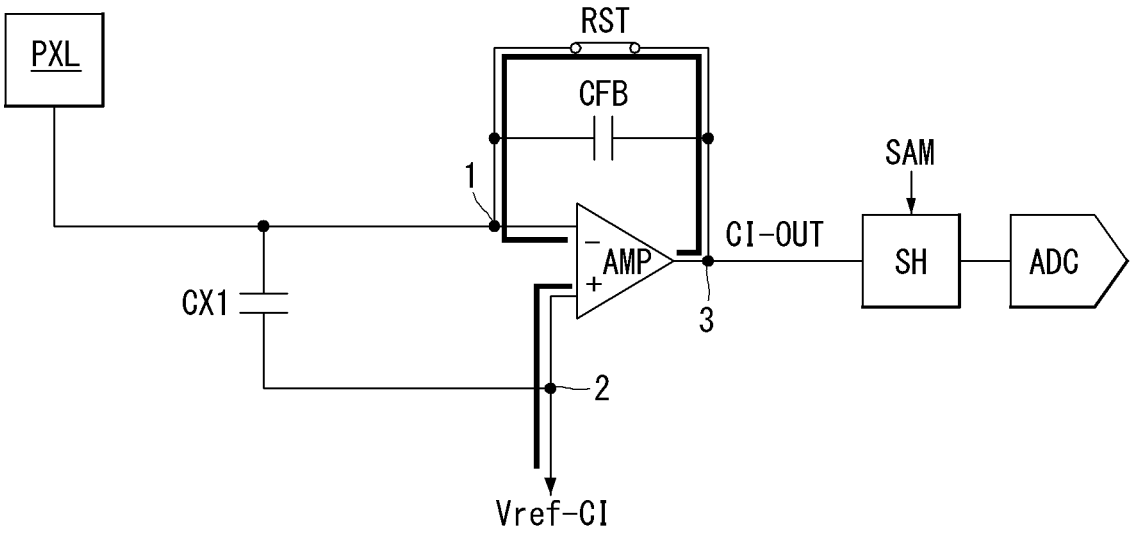
FIGS. 9 and 10 show the operations of the pixel sensing device in FIG. 7.
Figure 10:
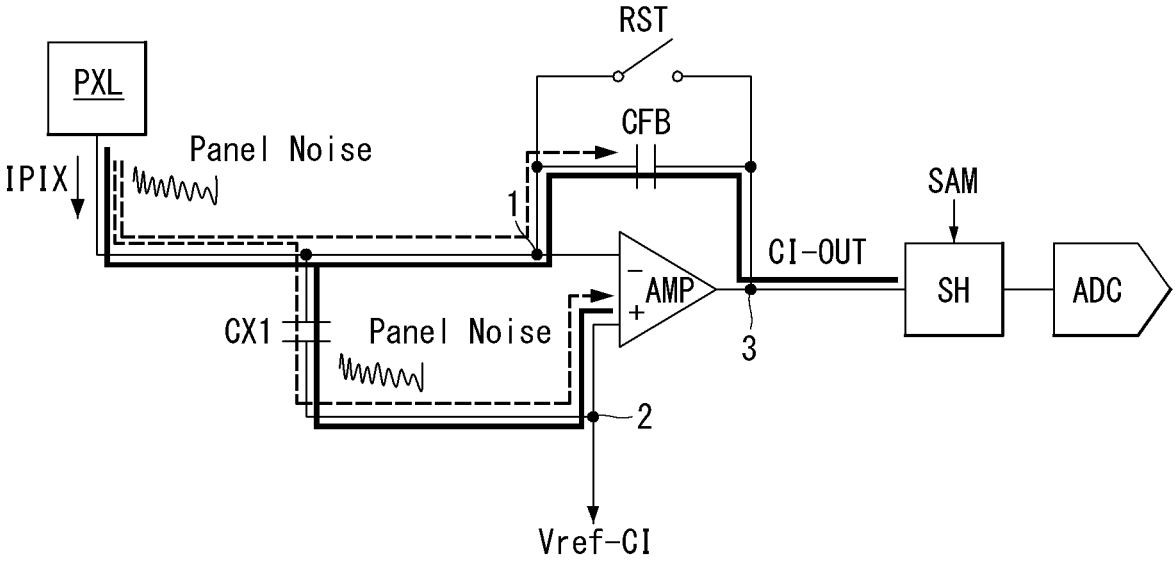

FIG. 8 shows the waveforms of the signals applied to the pixel sensing device in FIG. 7, and FIGS. 9 and 10 show the operations of the pixel sensing device in FIG. 7.

Referring to FIG. 8, the sense driving according to an embodiment of the present disclosure may be implemented to include an initializing period ① and a sensing period ②.

Referring to FIGS. 8 and 9, in the initializing period ①, the reset switch RST is turned on. If the reset switch RST is turned on, the sensing line as well as the first to third nodes (1), (2) and (3) are initialized to the integrator reference voltage Vref-CI. So, in the initializing period ① the integrator output voltage CI-OUT becomes the integrator reference voltage Vref-CI.

Referring to FIGS. 8 and 10, in the sensing period ②, the reset switch RST is turned off and the charges according to the pixel current IPIX input through the sensing line and the first node (1) are accumulated in the integrating capacitor CFB. As the charges according to the pixel current IPX are accumulated in the integrating capacitor CFB, the integrator output voltage CI-OUT is gradually lowered from the integrator reference voltage Vref-CI.

In the sensing period ②, since the panel noise mixed into the pixel current IPIX is applied to both the input terminals (+) and (−) of the amplifier AMP through the first capacitor CX1 and canceled inside the amplifier AMP, the panel noise to be mixed into the integrator output voltage CI-OUT is reduced or minimized.

In the sensing period ②, the sample and hold unit SH samples the integrator output voltage CI-OUT during the sampling signal SAM is of on level.

Figure 11:
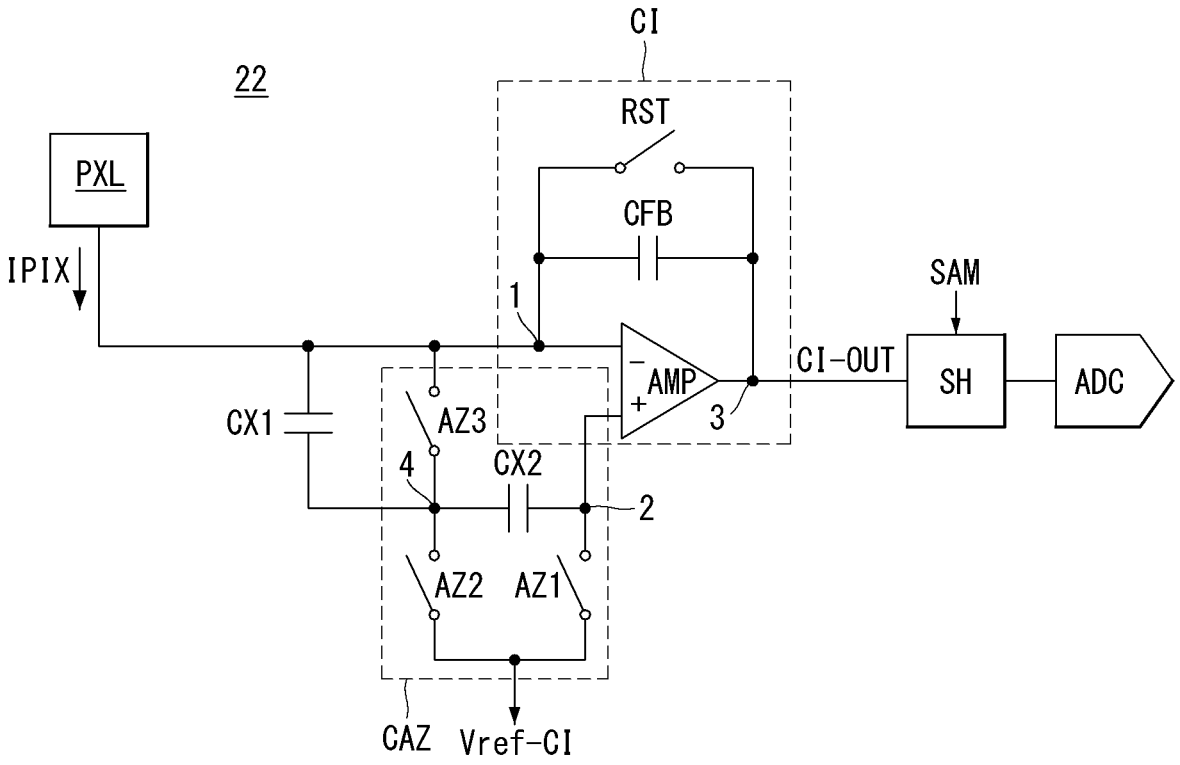
FIG. 11 shows the pixel sensing device according to another embodiment of the present disclosure.

FIG. 11 shows the pixel sensing device according to another embodiment of the present disclosure. The pixel sensing device in FIG. 11 may further improve sensing accuracy because it can further remove an amplifier offset as compared to that of FIG. 7.

Referring to FIG. 11, the sensing unit 22 may comprise a current integrator CI, a sample and hold unit SH, an ADC and a first capacitor CXI, and may further comprise an offset cancelling unit CAZ.

The current integrator CI is connected to a pixel PXL through a sensing line of the display panel 10. The current integrator CI integrates the pixel current IPIX flowing through the pixel PXL to generate an integrator output voltage CI-OUT that varies from an integrator reference voltage Vref-CI.

The current integrator CI comprises an amplifier AMP, an integrating capacitor CFB and a reset switch RST. The amplifier AMP is equipped with a first input terminal to receive the pixel current IPIX through a first node (1) connected to the sensing line, a second input terminal to receive the integrator reference voltage Vref-CI through a second node (2) and an output terminal to output the integrator output voltage CI-OUT corresponding to a result of integrating the pixel current IPIX to a third node (3). The integrating capacitor CFB is connected between the first node (1) and the third node (3), that is, the integrating capacitor CFB is connected between the first input terminal and the output terminal of the amplifier AMP. The reset switch RST is further connected between the first input terminal and the output terminal of the amplifier AMP in parallel with the integrating capacitor CFB.

The sample and hold unit SH samples and holds the integrator output voltage CI-OUT and then outputs it to the ADC. The sample and hold unit SH may comprise a sampling capacitor, a sampling switch and a holding switch operating according to a sampling signal SAM, but is not limited thereto.

The ADC converts an analog signal (that is the integrator output voltage) into a digital signal (that is digital sensing result data) within a predetermined sensing range.

The first capacitor CX1 serves to reduce or minimize the distortion degree of the integrator output voltage CI-OUT due to panel noise, together with a second capacitor CX2 included in the offset cancelling unit CAZ. The first capacitor CX1 and the second capacitor CX2 are connected between the first node (1) and the second node (2) to couple the first input terminal (−) and the second input terminal (+) of the amplifier AMP.

The offset cancelling unit CAZ is connected to the input terminal of the integrator reference voltage Vref-CI, the first node (1) and the second node (2), and applies to the amplifier AMP a correcting reference voltage which can cancel an offset of the amplifier AMP through the second node (2). The offset cancelling unit CAZ includes the second capacitor CX2 and first to third switches AZ1, AZ2 and AZ3.

The second capacitor CX2 is equipped with one electrode connected to the second node (2) and the other electrode connected to the first capacitor CX1 through a fourth node (4). Between the first node (1) and the second node (2), the second capacitor CX2 is connected in series with the first capacitor CX1. The second capacitor CX2 is connected to the first capacitor CX1 through the fourth node (4).

The first and second capacitors CX1 and CX2 allows the panel noise which is mixed to the pixel current IPIX to be commonly applied to both the input terminals (+) and (−) of the amplifier AMP. The panel noise mixed to the pixel current IPIX is applied to the first input terminal (−) of the amplifier AMP and also applied to the second input terminal (+) of the amplifier AMP through the first and second capacitors CX1 and CX2. So, the panel noise applied to both the input terminals (+) and (−) of the amplifier AMP may be canceled inside the amplifier AMP to be reduced or minimized.

The larger the capacitances of the first and second capacitors CX1 and CX2, the smaller the amount of the panel noise that is mixed into the integrator output voltage CI-OUT. This is because the magnitude of the panel noise applied to the first input terminal (−) of the amplifier AMP becomes similar to that of the panel noise applied to the second input terminal (+) of the amplifier AMP as the capacitance of the first and second capacitors CX1 and CX2 becomes larger. Ideally, when the magnitudes of the panel noise applied to both the input terminals (+) and (−) of the amplifier AMP are same, the panel noise to be mixed into the integrator output voltage CI-OUT may be completely canceled.

Meanwhile, the first switch AZ1 is connected between the second node (2) and the input terminal of the integrator reference voltage Vref-CI. The second switch AZ2 is connected between the fourth node (4) and the input terminal of the integrator reference voltage Vref-CI. The third switch AZ3 is connected between the first node (1) and the fourth node (4). By the switching actions of the first to third switches AZ1, AZ2 and AZ3 and the coupling effect of the second capacitor CX2, the correcting reference voltage which may cancel the offset of the amplifier AMP may be applied to the amplifier AMP through the second node (2).

Figure 12:
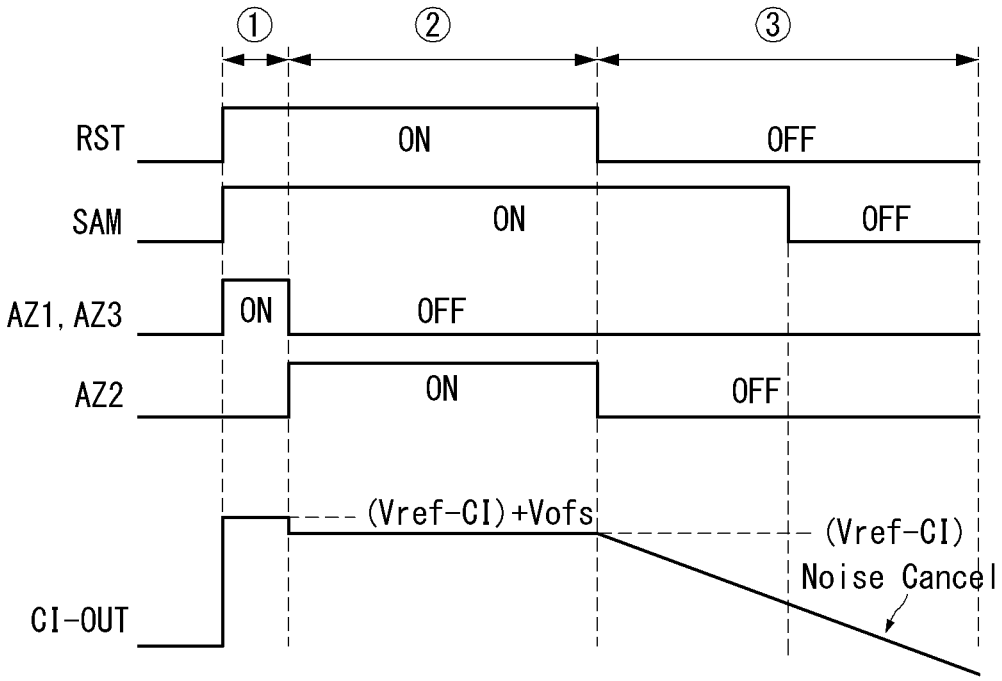
FIG. 12 shows the waveforms of the signals applied to the pixel sensing device in FIG. 11.

FIG. 12 shows the waveforms of the signals applied to the pixel sensing device in FIG. 11, and FIGS. 13 to 15 show the operations of the pixel sensing device in FIG. 11.

Referring to FIG. 12, the sense driving according to another embodiment of the present disclosure may be implemented to include an offset detecting period ①, an initializing period ②, and a sensing period ③.

Figure 13:
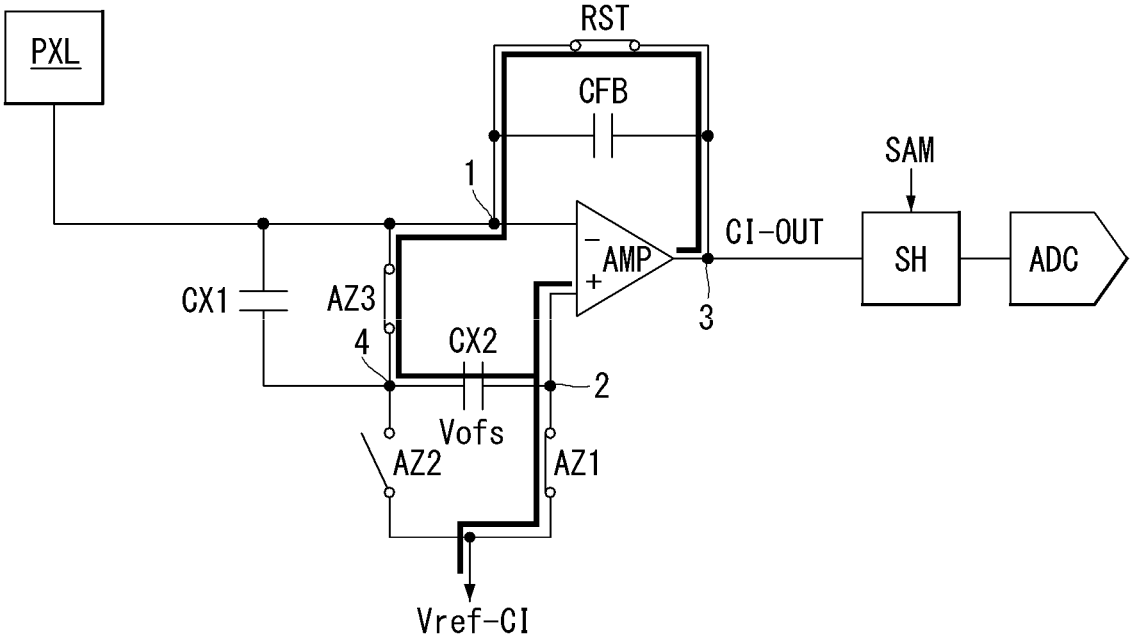
FIGS. 13 to 15 show the operations of the pixel sensing device in FIG. 11.

Referring to FIGS. 12 and 13, in the offset detecting period ①, the first and third switches AZ1 and AZ3 and the reset switch RST are turned on and the second switch AZ2 is turned off. If first and third switches AZ1 and AZ3 and the reset switch RST is turned on, the integrator reference voltage Vref-CI is applied to the second node (2), and a first integrator reference voltage (Vref-CI+Vofs) to which the offset Vofs of the amplifier AMP is added is applied to the first, third and fourth node (1), (3) and (4) and the sensing line. So, in the offset detecting period ①, the offset Vofs of the amplifier AMP is detected to be stored in the second capacitor CX2.

Figure 14:
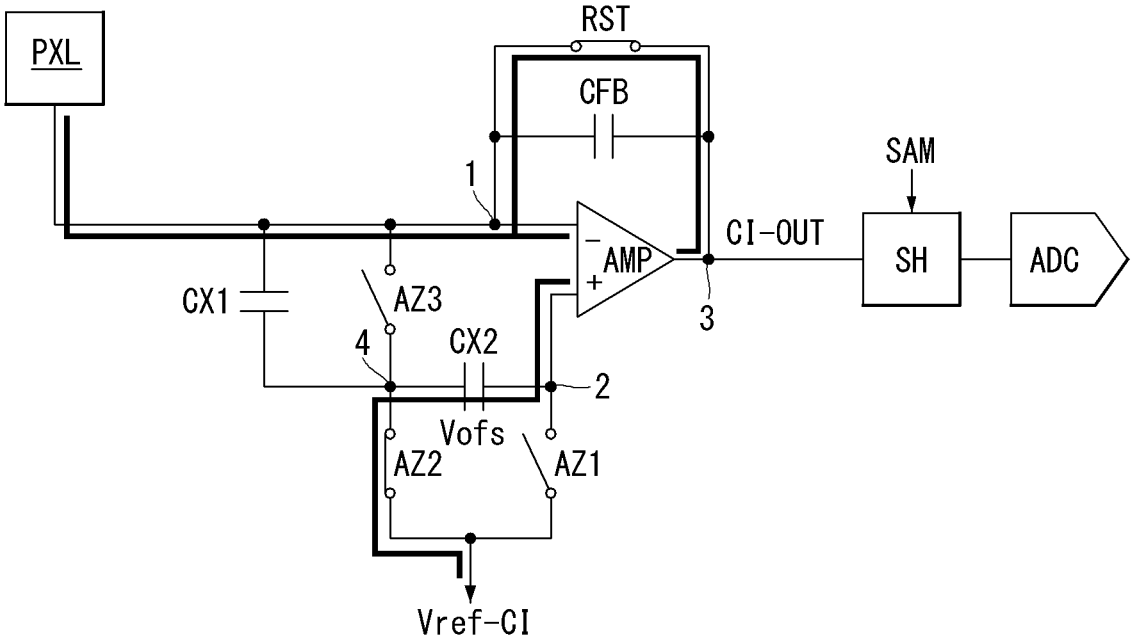

Referring to FIGS. 12 and 14, in the initializing period ①, the first switch AZ1 and the third switch AZ3 are turned off, and the reset switch RST and the second switch AZ2 are turned on. If the reset switch RST is turned on, the voltage of the fourth node (4) changes from a first integrator reference voltage (Vref-CI+Vofs) to the integrator reference voltage Vref-CI. Since the first switch AZ1 is turned off at this time, the second node (2) is floated, and the voltage of the second node (2) changes from the integrator reference voltage Vref-CI to a second integrator reference voltage (Vref-CI−Vofs) due to the coupling action of the second capacitor CX2. The offset Vofs of the amplifier AMP is canceled by the second integrator reference voltage (Vref-CI−Vofs) applied through the second node (2). And, since the reset switch RST is of a turn-on state at this time, the voltages of the first node (1), the third node (3) and the sensing line change from the first integrator reference voltage (Vref-CI+Vofs) to the integrator reference voltage Vref-CI. That is, in the initializing period ②, the voltages of the first node (1) and the third node (3) is initialized to the integrator reference voltage Vref-CI while the offset Vofs of the amplifier AMP is removed.

Figure 15:
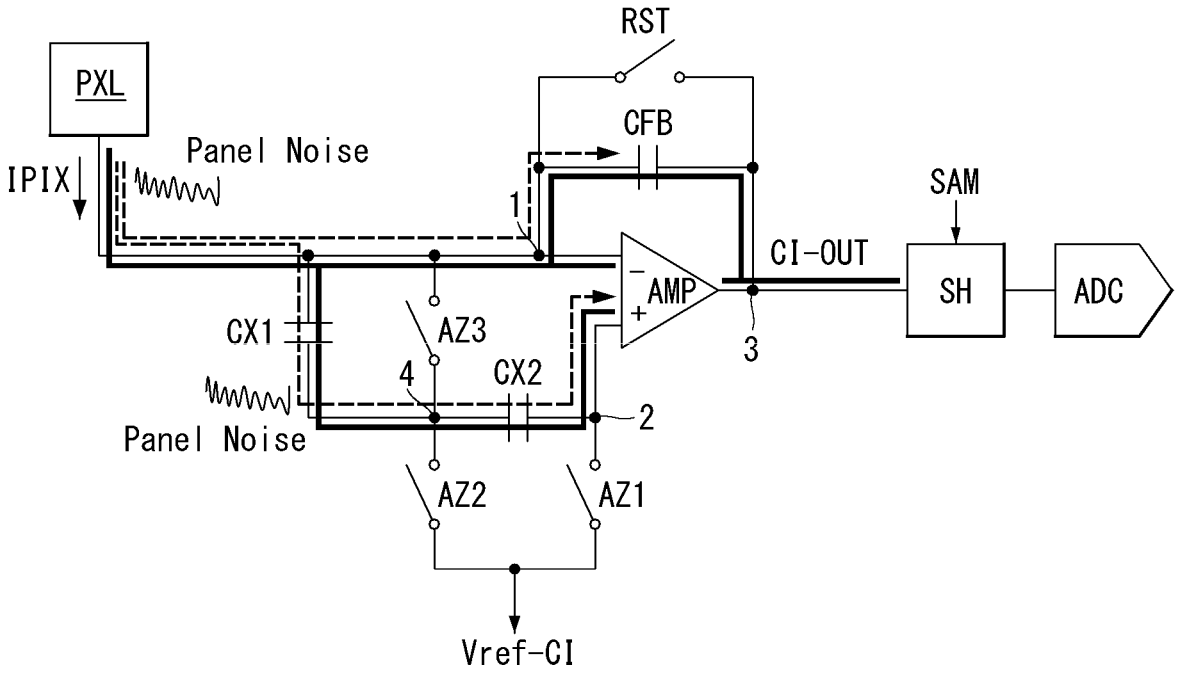

Referring to FIGS. 12 and 15, in the sensing period ③, the first switch AZ1, the second switch AZ2, the third switch AZ3 and the reset switch RST are turned off, the charges according to the pixel current IPIX input through the sensing line and the first node (1) are accumulated in the integrating capacitor CFB. As the charges according to the pixel current IPX are accumulated in the integrating capacitor CFB, the integrator output voltage CI-OUT is gradually lowered from the integrator reference voltage Vref-CI.

In the sensing period ③, since the panel noise mixed into the pixel current IPIX is applied to both the input terminals (+) and (−) of the amplifier AMP by the first and second capacitors CX1 and CX2 and canceled inside the amplifier AMP, the panel noise to be mixed into the integrator output voltage CI-OUT is reduced or minimized.

In the sensing period ③, the offset of amplifier AMP is removed from the integrator output voltage CI-OUT, so the distortion of the integrator output voltage CI-OUT due to the offset Vofs of the amplifier AMP is remarkably reduced.

In the sensing period ③, the sample and hold unit SH samples the integrator output voltage CI-OUT during the sampling signal SAM is of on level.

Figure 16:
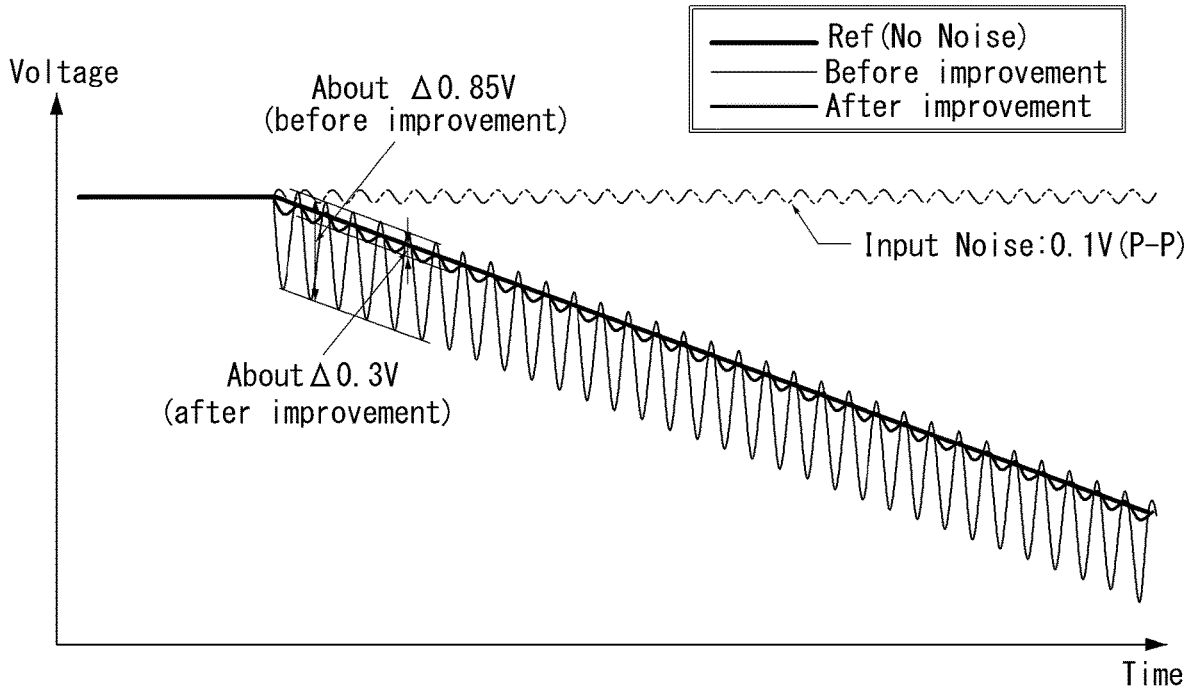
FIGS. 16 and 17 show the simulated results relating to panel noise improvement.
Figure 17:
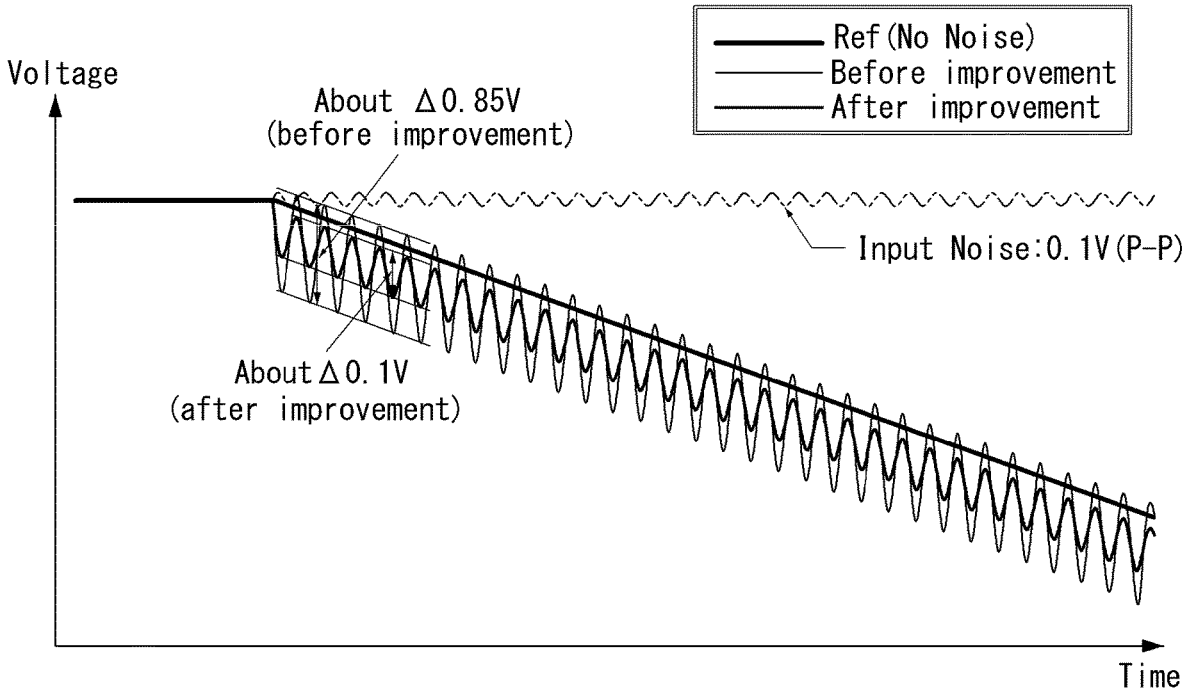

FIGS. 16 and 17 show the simulated results relating to panel noise improvement.

As known from the simulated results of FIGS. 16 and 17, if the pixel sensing device applies the panel noise mixed to the pixel current IPIX to both the input terminals (+) and (−) through the first capacitor CX1 or through the first and second capacitors CX1 and CX2 and integrates the pixel current IPIX, it may remarkably reduce the magnitude of the panel noise to be mixed to the integrator output voltage CI-OUT.

Referring to FIG. 16, when setting the capacitance of the first capacitor CX1 or the combined capacitance of the first capacitor CX1 and the second capacitor CX2 to be 10 pF, the magnitude of the panel noise becomes about 0.3V, which is a significant improvement over 0.85V before improvement (capacitorless).

Referring to FIG. 17, when increasing the capacitance of the first capacitor CX1 or the combined capacitance of the first capacitor CX1 and the second capacitor CX2 to be 50 pF, the magnitude of the panel noise becomes about 0.1V, which is a remarkable improvement over 0.85V before improvement (capacitorless).

Referring to FIGS. 16 and 17, it can be known that the larger the capacitance of the first capacitor CX1 (or the combined capacitance of the first capacitor CX1 and the second capacitor CX2), the less the amount of the panel noise to be mixed to the integrator output voltage CI-OUT.

As described above, in the present disclosure, the capacitor for suppressing the panel noise is equipped in the sensing unit together with the current integrator, thereby minimizing the amount of panel noise mixed to the integrator output voltage, thereby improving the accuracy and reliability of sensing.

And, by further comprising the offset cancelling circuit in the sensing unit, the present disclosure may reduce or minimize the distortion of the integrator output voltage which occurs due to the offset of the integrating amplifier to further improve the accuracy and reliability of sensing.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A pixel sensing device, comprising:

a current integrator connected to a pixel through a sensing line of a display panel, the current integrator integrating a pixel current flowing through the pixel to generate an integrator output voltage, the pixel current including panel noise;

a sample and hold unit sampling and holding the integrator output voltage;

an analog to digital converter converting the integrator output voltage output from the sample and hold unit into a digital signal; and a first capacitor coupled to the current integrator serving to reduce a distortion degree of the integrator output voltage due to the panel noise mixed to the pixel current, wherein the current integrator includes:

an amplifier having a first input terminal connected to the sensing line for receiving the pixel current, a second input terminal for receiving an integrator reference voltage, and an output terminal for outputting the integrator output voltage that varies from the integrator reference voltage; and a reset switch connected between the first input terminal and the output terminal of the amplifier, wherein the first capacitor is directly connected to the first input terminal and the second input terminal of the amplifier, and wherein the panel noise mixed in the pixel current is commonly applied to the first input terminal of the amplifier and the second input terminal of the amplifier when the reset switch is turned off.

2. The pixel sensing device according to claim 1, wherein the current integrator further comprises:

an integrating capacitor connected between the first input terminal and the output terminal of the amplifier in parallel with the reset switch.

3. The pixel sensing device according to claim 2, wherein the panel noise mixed to the pixel current is applied to the first input terminal of the amplifier and applied to the second input terminal of the amplifier through the first capacitor, such that the panel noise is canceled inside the amplifier to be reduced, in a sensing period in which charges of the pixel current are accumulated in the integrating capacitor.

4. The pixel sensing device according to claim 2, further comprising:

an offset cancelling unit serving to remove an offset of the integrating amplifier from the integrator output voltage.

5. The pixel sensing device according to claim 4, wherein the offset cancelling unit comprises:

a second capacitor connected between the first capacitor and the second input terminal of the amplifier and coupling the first input terminal and the second input terminal of the amplifier together with the first capacitor;

a first switch connected between the second input terminal of the amplifier and an input terminal of the integrator reference voltage;

a second switch connected between the input terminal of the integrator reference voltage and a node between the first capacitor and the second capacitor; and a third switch connected between the first input terminal of the amplifier and the node between the first capacitor and the second capacitor.

6. The pixel sensing device according to claim 5, wherein the first switch, the third and the reset switch are turned on and the second switch is turned off to store the offset of the amplifier in the second capacitor, in an offset detecting period.

7. The pixel sensing device according to claim 5, wherein the first switch and the third switch are turned off and the reset switch and the second switch are turned on to float the second input terminal of the amplifier and initialize voltages of the first input terminal and the output terminal of the amplifier to the integrator reference voltage, in an initializing period.

8. The pixel sensing device according to claim 5, wherein the first switch, the second switch, the third switch and the reset switch are turned off to accumulate charges of the pixel current in the integrating capacitor and generate the integrator output voltage from which the offset of the amplifier is removed, in a sensing period.

9. The pixel sensing device according to claim 8, wherein the panel noise mixed to the pixel current is applied to the first input terminal of the amplifier and applied to the second input terminal of the amplifier through the first capacitor and the second capacitor, such that the panel noise is canceled inside the amplifier to be reduced, in the sensing period.

10. The pixel sensing device according to claim 1, wherein the first capacitor is directly connected to the sensing line and the second input terminal of the amplifier when the reset switch is turned off.

11. The organic light emitting display device according to claim 1, wherein the panel noise mixed in the pixel current includes a first portion and a second portion, and wherein the panel noise output at the output terminal of the amplifier is reduced based on the first portion of the panel noise mixed in the pixel current and the second portion of the panel noise mixed in the pixel current being respectively applied to the first and second input terminals.

12. The organic light emitting display device according to claim 11, wherein the first portion of the panel noise mixed in the pixel current and the second portion of the panel noise mixed in the pixel current are substantially identical to each other.

13. An organic light emitting display device, comprising:

a display panel including a plurality of pixels; and a sensing unit for sensing driving characteristics of the pixel, the sensing unit including:

a current integrator connected to the pixel through a sensing line of the display panel, the current integrator integrating a pixel current flowing through the pixel to generate an integrator output voltage, the pixel current including panel noise;

a sample and hold unit sampling and holding the integrator output voltage;

an analog to digital converter converting the integrator output voltage output from the sample and hold unit into a digital signal; and a first capacitor adjacent to the current integrator serving to reduce a distortion degree of the integrator output voltage due to the panel noise mixed to the pixel current, wherein the current integrator includes:

an amplifier having a first input terminal connected to the sensing line for receiving the pixel current, a second input terminal for receiving an integrator reference voltage, and an output terminal for outputting the integrator output voltage that varies from the integrator reference voltage; and a reset switch connected between the first input terminal and the output terminal of the amplifier, wherein the first capacitor is directly connected to the first input terminal and the second input terminal of the amplifier, wherein a first portion of the panel noise mixed in the pixel current is provided to the first input terminal of the amplifier when the reset switch is turned off and a second portion of the panel noise mixed in the pixel current is provided to the second input terminal of the amplifier when the reset switch is turned off.

14. The organic light emitting display device according to claim 13, further comprising:

a driving voltage generator for generating data voltage for sensing for sense driving and data voltage for displaying for display driving and supplying them to a data line of the display panel, and generating a reference voltage for the sense driving and the display driving and supplying it to a reference voltage line of the display panel.

15. The organic light emitting display device according to claim 14, wherein the data line is used as the sensing line.

16. The organic light emitting display device according to claim 14, wherein the reference voltage line is used as the sensing line.

17. The organic light emitting display device according to claim 14, further comprising:

a compensating unit for calculating a compensating value for compensating for a change of the driving characteristics of the pixel based on a digital sensing result data from the sensing unit, correcting an image data input from a host system according to the compensating value, and supplying the corrected image data to the driving voltage generator, wherein the driving voltage generator generates the data voltage for displaying based on the corrected image data.

18. The organic light emitting display device according to claim 14, wherein the sensing unit and the driving voltage generator are included in a data driving unit.

19. The organic light emitting display device according to claim 13, further comprising:

a timing controller for controlling sense driving timing and display driving timing of the display panel, wherein the sensing unit senses the driving characteristics of the pixel during at least one of a power on section, a vertical active interval in each frame, a vertical blank interval in each frame and a power off section under control of the timing controller.

20. The organic light emitting display device according to claim 13, wherein the panel noise output at the output terminal of the amplifier is reduced based on the first portion of the panel noise mixed in the pixel current and the second portion of the panel noise mixed in the pixel current being commonly applied to the first and second input terminals, respectively.

* * * * *